US009752250B2

(12) United States Patent
Vacheron

(10) Patent No.: US 9,752,250 B2
(45) Date of Patent: Sep. 5, 2017

(54) EQUIPMENT FOR THE SURFACE TREATMENT OF PARTS BY IMMERSION IN A PROCESSING LIQUID

(71) Applicant: Frédéric Vacheron, Menthon Saint Bernard (FR)

(72) Inventor: Frédéric Vacheron, Menthon Saint Bernard (FR)

(73) Assignee: CATIDOM, Seynod (FR)

( * ) Notice: Subject to any disclaimer, the term of this patent is extended or adjusted under 35 U.S.C. 154(b) by 0 days.

(21) Appl. No.: 14/189,468

(22) Filed: Feb. 25, 2014

(65) Prior Publication Data

US 2014/0238448 A1 Aug. 28, 2014

(30) Foreign Application Priority Data

Feb. 26, 2013 (FR) ..... 13 51656

(51) Int. Cl.

| | |
|---|---|
| ***B05C 3/04*** | (2006.01) |
| ***B05C 3/09*** | (2006.01) |
| ***B05C 3/10*** | (2006.01) |
| ***C25D 17/02*** | (2006.01) |
| ***C25D 17/06*** | (2006.01) |

(52) U.S. Cl.

CPC ..... *C25D 17/06* (2013.01); *B05C 3/09* (2013.01); *B05C 3/10* (2013.01); *C25D 17/02* (2013.01); *B05C 3/04* (2013.01)

(58) Field of Classification Search

CPC .... B05C 3/04; B05C 3/09; B05C 3/10; C25D 17/02; C25D 17/06

USPC ..... 118/400, 416; 134/135; 427/425, 430.1

See application file for complete search history.

(56) References Cited

U.S. PATENT DOCUMENTS

| | | | | |
|---|---|---|---|---|
| 826,258 | A | 7/1906 | Lakin | |
| 4,955,209 | A * | 9/1990 | Smith | F25D 3/11 134/135 |
| 2003/0213429 | A1 | 11/2003 | Kreuzer | |
| 2009/0123658 | A1 | 5/2009 | Powell et al. | |

FOREIGN PATENT DOCUMENTS

| | | |
|---|---|---|
| DE | 3739602 | 6/1989 |
| WO | WO2011/123132 | 10/2011 |

OTHER PUBLICATIONS

French Search Report in related application No. FR1351656, dated Oct. 23, 2013.

* cited by examiner

*Primary Examiner* — Michael Barr
*Assistant Examiner* — Levon J Shahinian
(74) *Attorney, Agent, or Firm* — Greenblum & Bernstein, P.L.C.

(57) ABSTRACT

Installation for surface treatment of parts. The installation includes at least one treatment tank containing a processing liquid in which an arm carrying on one of its ends at least one part support comprising a lower surface and an upper surface holding the parts to be treated is at least partially immersed. The arm is rotationally mounted about an axis located on the outside of the tank and in an area below the area formed by the upper end edge of the tank.

8 Claims, 3 Drawing Sheets

EQUIPMENT FOR THE SURFACE TREATMENT OF PARTS BY IMMERSION IN A PROCESSING LIQUID

CROSS-REFERENCE TO RELATED APPLICATIONS

The present application claims priority under 35 U.S.C. §119(a) of French Patent Application No. 1351656 filed Feb. 26, 2013, the disclosure of which is expressly incorporated by reference herein in its entirety.

BACKGROUND OF THE INVENTION

1. Field of the Invention

The present invention relates to an improvement to the method of continuous surface treatment of parts using the principle of immersion and transfer of parts, such as the treatment of metal parts, and more particularly to a conversion treatment such as, for example, treatment of an aluminum part by anodization, or by electrolysis.

The present invention relates more particularly to a new type of installation for surface treatment.

2. Background Information

Various methods of surface treatment of parts, more particularly metal parts made, for example, of aluminum, steel, copper, brass, as well as parts made of plastic materials, are known. Notable examples include anodic treatments of aluminum and its alloys, cathodic treatments of ferrous alloys, such as steel, or non-ferrous alloys, such as copper or brass, and metallization treatments in aqueous phases of plastic materials. Similarly, the surface treatment of parts by electrolysis is a well-known method, which requires use of an electric current to carry out the treatment.

The parts undergoing a surface treatment by immersion are generally attached to supports referred to as tools. These tools are then grouped on frames that are themselves moved from tank to tank by means of hoists.

In a conventional installation, the parts to be treated, attached to their supports, are immersed vertically, from top to bottom, in the processing baths, in which they remain immobile throughout the treatment. This technique has two major drawbacks for the surface treatment of the parts: firstly, the parts to be treated remain immobile during treatment, which makes such treatment uneven on the various surfaces of each part; secondly, the surfaces of the tools and their supporting frame are themselves subject to the treatment and thus consume a substantial portion of the energy and metals used for the transformation or deposit sought to be achieved by the surface treatment operation.

SUMMARY

The present invention provides a significant improvement to the treatment of parts by subjecting the parts to an agitation by oscillation during the phase of immersion in the processing bath. The invention also makes it possible to reduce to the minimum necessary the surfaces of the supports to which the parts are attached, and to reduce the consumption of metals and energy by the surface of the supports during the treatment phase, while improving the quality of the treatment on the parts.

Thus, the installation for the surface treatment of parts according to the invention includes at least one treatment tank containing a processing liquid in which is at least partially immersed an arm carrying on one of its ends at least one part support, comprising a lower surface and an upper surface holding the parts to be treated in position, characterized in that it is rotationally mounted about an axis (X) located on the outside of the tank, on the one hand, and in an area below the area formed by the upper end edge of the tank, on the other hand.

According to an additional characteristic, the arm has a generally non-rectilinear but concave shape, which is either C-shaped, or formed of a plurality of non-coextensive portions.

According to another additional characteristic, the arm(s) has/have two end positions, in one of which the part support is held on the outside of the tank, such that the general plane of the support(s) is parallel to the plane defined by the surface of the liquid contained in the tank, the lower surface of the support being opposite the bottom of the tank, thereby enabling the treated parts to be properly emptied of the excess liquid after treatment.

According to yet another additional characteristic, the arm(s) comprise(s) two end positions, in one of which the part support(s) is/are retained such that the general plane of the support is in a position whereby the upper surface of the part support is opposite the bottom of the tank.

According to one of the embodiments, the arm(s) is/are substantially C-shaped, one end of which is attached to the axis of rotation and the other end portion of which carries the part support which is adapted to be immersed in the bath by the rotational action of the arm(s).

It should be noted that the axis of rotation is rotated by the action of a motor located in an area below the area formed by the upper edge of the tank.

According to one of the embodiments, the tank has an outward extension in its upper portion for protecting the motor and the axis, as well as for recovering the excess processing liquid when the part support is held outside of the tank.

Moreover, the part supports are removably held on slide racks attached to the end of the arm(s), opposite the end connected to the axis of rotation.

BRIEF DESCRIPTION OF DRAWINGS

Other characteristics and advantages of the invention will become apparent from the following description, with reference to the annexed drawings, given only by way of non-limiting examples, in which.

DETAILED DESCRIPTION

Figure 1:
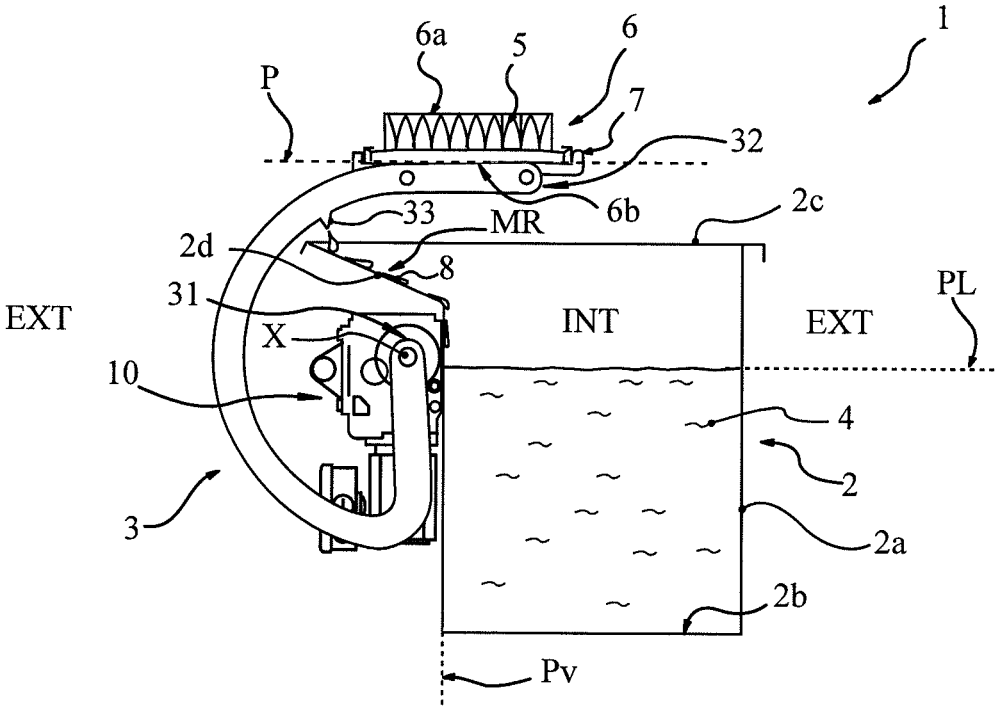
FIGS. 1 and 2 are lateral cross-sectional views along the line A-A of the installation.
Figure 2:
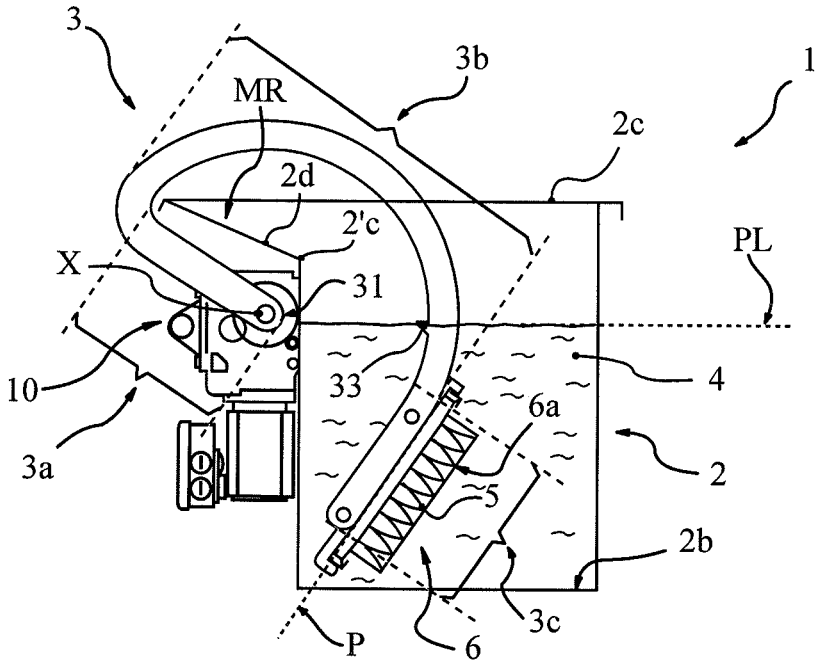
Figure 3:
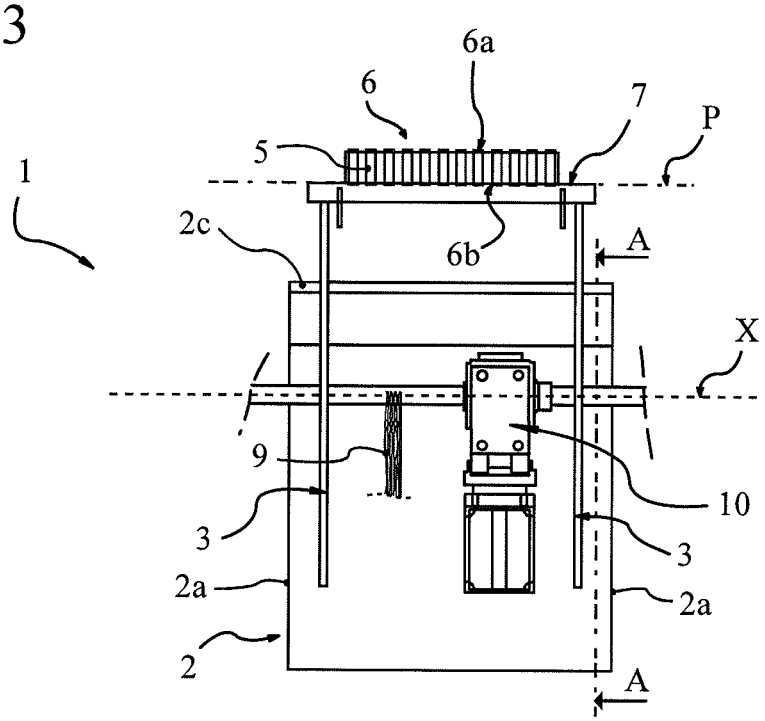
FIG. 3 is a rear view of the installation.

The treatment installation of the invention comprises at least one tank (2) for the surface treatment of parts (5), containing a processing liquid (4) in which the parts to be treated are immersed (5). The parts (5) are held on at least one support (6), advantageously perpendicular to the general plane (P) of the support. The support(s) (6) is/are removably retained by at least one slide rack (7) attached to one of the ends (32) of one or more rotationally movable arms (3). The support(s) (6) comprise(s) a lower surface (6*b*) and an upper surface (6*a*), the lower surface (6*b*) comprising means for retention on the slide rack(s), and the upper surface (6*a*) comprising means for attaching the parts (5) to be treated.

According to the method using the treatment installation of the invention, each part (5) is immersed in a tank (2), making it undergo at least one rotational movement, such that the air bubbles likely to be created within the tank are driven out, thereby enabling the processing liquid (4) to treat the part (5) in its entirety, making the treatment completely homogeneous.

The movable arm(s) (3) of the invention is/are substantially C-shaped, one end (31) of which is attached to an axis of rotation (X) actuated by a motor (10), and the other opposite free end (32) of which carries one or more part supports (6) through a slide rack (7), thereby enabling the part support (6) to be removably retained.

According to the invention, the axis of rotation (X) is rotated by the action of a motor (10), and according to the preferred embodiment of the invention, the axis (X) is located on the outside of the tank, in an area below the area formed by the upper edge (2*c*) of the tank (2).

The arm(s) of the invention is/are therefore movable along a rotational movement whose center is the axis (X), and thereby enables the free end (32) opposite that attached to the axis (X) to be alternately immersed in the liquid (4) and emerged therefrom in a reciprocating movement.

In the uppermost position, whereby the free end(s) of the arm(s) (3) is/are emerged, the arm(s) (3) is/are no longer in contact with the liquid (4). In this position, the part support is held by the arm(s) (3) is on the outside (EXT) of the tank (2) or at least emerged from the liquid (4), in a position whereby the general plane the support (P) is substantially parallel to the plane (PL) determined by the surface of the processing liquid (4) contained in the tank (2).

In another lowermost position, whereby the free end (32) of the arm(s) (3) is immersed, the part support(s) (6) is/are held such that the general plane (P) of the support(s) is in a position whereby the upper surface (6*a*) of the support (6) of the parts (5) is opposite the bottom (2*b*) of the tank (2).

According to the preferred embodiment of the invention, the tank (2) comprises a bottom wall (2*b*) and four vertical walls (2*a*) forming a space containing the processing liquid (4). One of the vertical walls comprises means (MR) for recovering the excess liquid (4) carried along by the treated parts, the part support(s) (6), the slide rack(s) (7) and the portion of the arm(s) that was/were immersed during treatment. These recovery means (MR) are formed by a substantially horizontal wall portion (2*d*) on the upper end (2*c*) of one of the vertical walls (2*a*). According to the preferred embodiment of the invention, the upper end (2*c*) of one of the vertical walls (2*a*) of the tank (2) comprises an extension toward the outside (EXT), and the wall portion (2*d*) is substantially inclined, thus forming an inclined surface whose slope is directed towards the inside (INT) of the tank (2) for returning the excess liquid (4) into the tank (2). The wall portion (2*d*) therefore comprises four sides (2*a*), one of which is advantageously in contact with one of the upper ends (2'*c*) of one of the vertical walls (2*a*) of the tank (2), or within the space defined by the tank (2), the side opposite thereto is advantageously located on the outside (EXT) of the tank (2) and the other two lateral sides (2*a*) opposite one another. The length (L) of these walls is at least equal to half the length (L1) corresponding to the arm portion(s) immersed in the processing liquid (4).

According to an additional characteristic of the invention, the arm(s) (3) comprise(s) means, advantageously formed by a projection (33), for preventing the excess processing liquid (8) from flowing along the arm(s) (3) and from spreading on the axis (X), the motor and the ground.

According to the preferred embodiment of the invention, the motor (10) is advantageously attached to the outer surface of one of the walls (2*a*) of the tank (2). And according to other alternative embodiments, the motor (10) is attached to a support independent of the treatment tank (2).

Described in more detail, and according to the preferred embodiment, the arms(s) (3) of the invention comprise(s) a plurality of portions (3*a*, 3*b*, 3*c*). Thus, the arm(s) (3) comprise(s), at its/their end (31) attached to the motor or to the axis (X), a first rectilinear portion (3*a*) which, in one end position, is substantially parallel to the substantially vertical plane (Pv) formed by the walls of the tank (2), and in another end position is positioned so as to form an angle between 90° and 150° with respect to the advantageously vertical plane (Pv) of the walls of the tank. The second portion (3*b*), following the rectilinear portion (3*a*), has a substantially arcuate shape, and the following third portion (3*c*) is advantageously rectilinear for carrying the slide rack(s) (7) holding the support(s) (6) of the part(s) (5). According to an alternative of this embodiment, at least two arm portions are arcuate.

Figure 4:
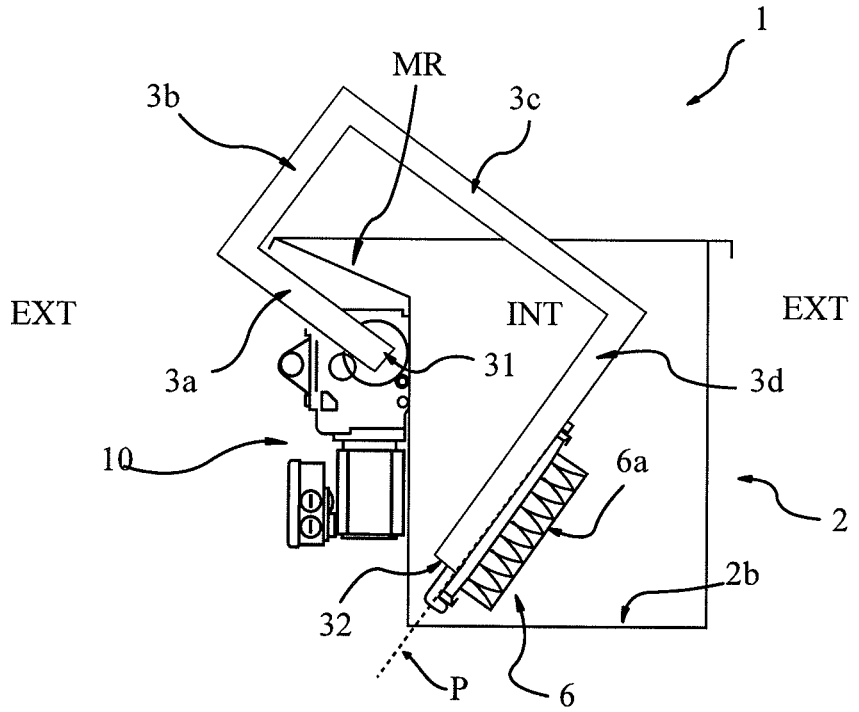
FIG. 4 is a lateral cross-sectional view along the line A-A of the installation according to a second embodiment.
Figure 5:
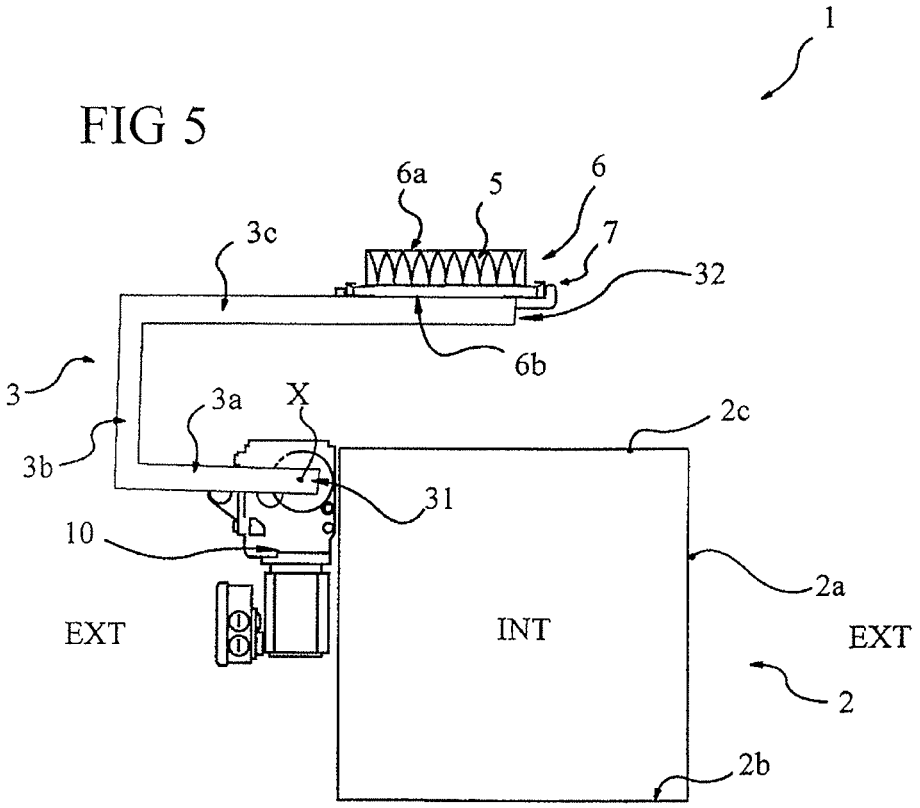
FIGS. 5 and 6 are lateral cross-sectional views along the line A-A of the installation, according to a third embodiment.
Figure 6:
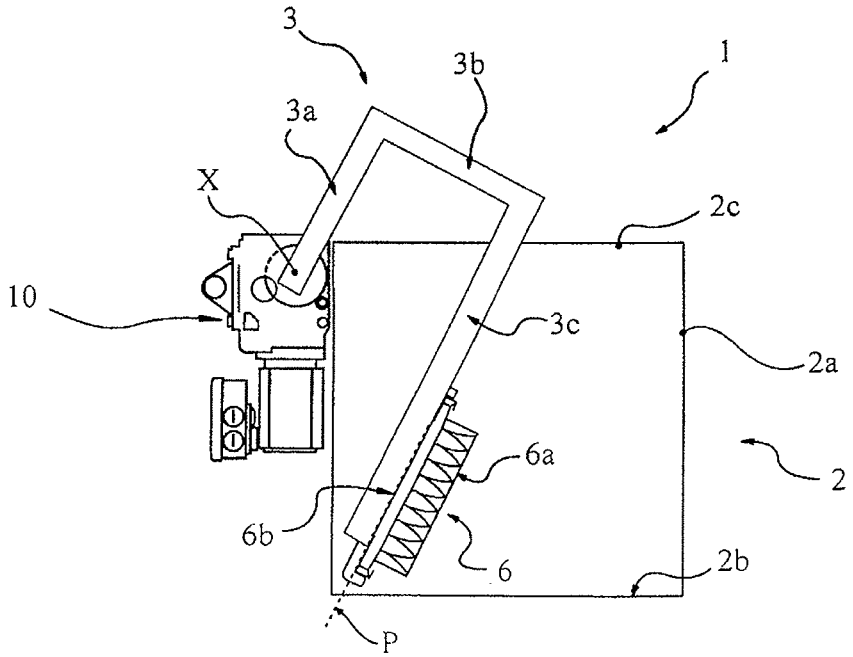

According to an alternative embodiment shown in FIG. 4, the arm portions (3*a*, 3*b*, 3*c*, 3*d*) are formed by rectilinear profiles and are four in number and integrated into the device with the same location for the motor (10) and the same construction for the tank (2). The arcuate portion of the first embodiment is formed, in this case, by at least two rectilinear profiles and advantageously by three rectilinear profiles, replacing the C-shaped profile by a U-shaped profile Also, according to still another embodiment shown in FIGS. 5 and 6, the arm(s) comprise(s) three portions (3*a*, 3*b*, 3*c*) formed by rectilinear profiles. The arm(s) (3) is/are substantially U-shaped, one end (32) of which is connected to the motor (10) and the other end (31) of which is connected to the support (6) for the parts (5). In this embodiment, the axis of rotation (X) of the motor (10) is close to the upper end of the tank (2), and the tank has no wall portion extending to the outside (EXT) on the upper end of one of the vertical walls (2*a*) of the tank (2). Indeed, when the support (6) for the part (5) is in the emerged upper position, the excess liquid (8) falls directly into the tank (2).

According to the invention the arm(s) (3) pivot(s) about the axis (X) along an amplitude greater than or equal to 90° and less than 180°.

The part support (6) therefore switches from an emerged horizontal position to a submerged inclined position in order to fill and empty the hollow parts (5) attached vertically to their support (6).

During the immersion time required to carry out the treatment, the parts (5) are moved back-and-forth at least once, from an upper end position to a lower end position and vice versa, as determined by the end position of the arm(s), upon actuation of the oscillating arm(s) caused by the motor (10). The zone in which the parts move is demarcated between the bottom of the tank and the liquid surface.

This mechanical agitation of the parts in the processing liquid makes it possible to improve the contact between the parts and the liquid contained in the tank, and to improve the chemical reactivity of the parts (5). This also provides better homogeneity of the processing bath (4).

The electrical contact required for certain treatment operations, in conversion treatments or treatments with deposit, is transmitted to the parts through a cooper braid (9) attached to the axis (X). The current travels along the axis, and then the oscillating arm(s) (3), and is finally transmitted to the supports (6) and the parts (5) to be treated.

In the case of a treatment by electroplating, such as copper plating, the parts to be treated are subjected by the copper braid (9) to a negative polarity, and the metal to be deposited, attached to an electrode, is subject to a positive polarity.

In the case of a treatment by electrolytic conversion, such as anodizing, the parts (5) to be treated are subjected by the copper braid (9) to a positive polarity, and the electrode is subject to a negative polarity.

According to the device of the invention, the various tanks required for the various treatment steps are aligned side by side to form a processing line.

The supports to which the parts are attached are transferred from one tank to the next tank by transfer means formed by arms and gripping elements connected by a common axis for moving all of the part supports from one position to the next in a single transverse movement.

In the installation of the invention, the conveyor chain is arranged above the tank(s), and the general conveyor axis is parallel to the axis of rotation of the arm(s).

The conveyor chain includes at least one movable carriage moving back-and-forth on a guide rail in order to enable one or more cassettes containing the parts already treated to be cleared, and one or more cassettes containing the parts not yet treated to be engaged.

The installation of the invention includes at least one treatment tank and a conveyor chain, and advantageously a downstream storage chain for the cassettes containing the untreated parts, and an upstream storage chain for the cassettes containing the treated parts.

It is understood that the axis of rotation (X) of the arm (3) is arranged on the outside of the tank and out of the zone occupied by the latter, on the one hand, and under the plane formed by the upper edge of the tank, on the other hand.

It is also understood that the arm (3) has a generally non-rectilinear but concave shape, which is either C-shaped, or formed of a plurality of non-coextensive portions.

The invention claimed is:

1. An installation for the surface treatment of parts including at least one treatment tank containing a processing liquid in which is at least partially immersed an arm carrying on one of its ends at least one part support comprising a lower surface and an upper surface holding the parts to be treated in position, wherein the arm is rotationally mounted about an axis of rotation, and wherein the axis is located on the outside of the tank and in an area below a region formed by the upper end edge of the tank, wherein the arm is rotatable by action of a motor located in the area below the region formed by the upper edge of the tank, and wherein the tank comprises an outward extension in its upper portion for protecting the motor and the axis, as well as for recovering excess processing liquid when the at least one part support is held outside of the tank.

2. The installation for the surface treatment of parts according to claim 1, wherein the arm has a generally non-rectilinear but concave shape, which is either C-shaped, or formed of a plurality of non-coextensive portions.

3. The installation for the surface treatment of parts according to claim 2, wherein the arm has two end positions, and wherein, in one of the positions, the part support is held on the outside of the tank such that the general plane of the support(s) is parallel to the plane defined by the surface of the liquid contained in the tank, the lower surface of said support being opposite the bottom of said tank, thereby enabling the treated parts to be properly emptied of excess liquid after treatment.

4. The installation for the surface treatment of parts according to claim 1, wherein the arm has two end positions, and wherein, in one of the positions, the part support(s) is/are held such that the general plane of the support is in a position whereby the upper surface of the part support is opposite the bottom of the tank.

5. The installation for the surface treatment of parts according to claim 1, wherein the arm is substantially C-shaped, one end of which is attached to the axis of rotation and the other end portion of which carries the part support which is adapted to be immersed in the at least one treatment tank by the rotational action of the arm.

6. The installation for the surface treatment of parts according to claim 1, wherein the arm pivots about the axis along an amplitude greater than 90° and less than 180°.

7. The installation for the surface treatment of parts according to claim 1, wherein the at least one part support is removably held on slide racks attached to the end of the arm, opposite the end connected to the axis of rotation.

8. The installation for the surface treatment of parts according to claim 1, wherein the at least one part support to which the parts are attached are transferred from one tank to other tanks aligned side by side to form a processing line, by a transfer arm, a plurality of said transfer arms being connected to one another in order to move all of the part supports from one position to a next position in a single transverse movement.

* * * * *